United States Patent [19]

Henkel, Sr.

[11] Patent Number: 4,703,782

[45] Date of Patent: Nov. 3, 1987

[54] METHOD AND APPARATUS FOR FILLING BULK BAGS

[76] Inventor: Ernest H. Henkel, Sr., 2815 Xanthus La., Plymouth, Minn. 55447

[21] Appl. No.: 808,451

[22] Filed: Dec. 12, 1985

[51] Int. Cl.[4] ..... B65B 1/12; B65B 1/26; B65B 1/04

[52] U.S. Cl. ..... 141/65; 141/59; 141/114; 141/256; 141/263; 141/275; 141/286; 141/287

[58] Field of Search ..... 141/1, 5-8, 141/10, 12, 59, 65, 67, 68, 83, 114, 128, 73, 251, 256, 263, 275, 276, 285-287, 313-317, 73, 93

[56] References Cited

U.S. PATENT DOCUMENTS

| | | | |
|---|---|---|---|
| 58,325 | 9/1866 | Warner | 141/256 |
| 949,240 | 2/1910 | Merritt | 141/286 |
| 1,653,200 | 12/1927 | Belcher | 141/10 |
| 1,791,654 | 2/1931 | Belcher | 141/275 |
| 2,114,104 | 4/1938 | Driscoll et al. | 141/256 |
| 2,142,990 | 1/1939 | Belcher | 141/256 X |
| 2,330,862 | 10/1943 | Bleam | 141/286 |
| 2,799,465 | 7/1957 | Carter | 141/65 |
| 2,985,201 | 5/1961 | Baker | 141/12 |
| 3,191,642 | 6/1965 | Saito | 141/128 |
| 3,384,134 | 5/1968 | Hillerns | 141/10 |
| 3,578,041 | 5/1971 | Obara | 141/59 |
| 3,664,385 | 5/1972 | Carter | 141/12 |
| 3,785,410 | 1/1974 | Carter | 141/10 |
| 4,054,161 | 10/1977 | Alack | 141/12 |
| 4,097,546 | 6/1978 | Bassendale et al. | 141/1 |
| 4,182,386 | 1/1980 | Alack | 141/93 |
| 4,185,669 | 1/1980 | Jevakohoff | 141/59 |

*Primary Examiner*—Henry J. Recla
*Assistant Examiner*—Ernest G. Cusick
*Attorney, Agent, or Firm*—Fitch, Even, Tabin & Flannery

[57] ABSTRACT

A method and apparatus for filling bulk bags employ a filling tube assembly comprising an inner tubular wall having an auger disposed therein for forcing powdered material into a bulk bag and packing it densely therein, and an air-permeable outer tubular wall disposed coaxially about the inner tubular wall to define an exhaust chamber so that air in the material may be drawn inwardly through the outer tubular wall when the filling tube assembly is immersed in the material.

5 Claims, 4 Drawing Figures

FIG. 2
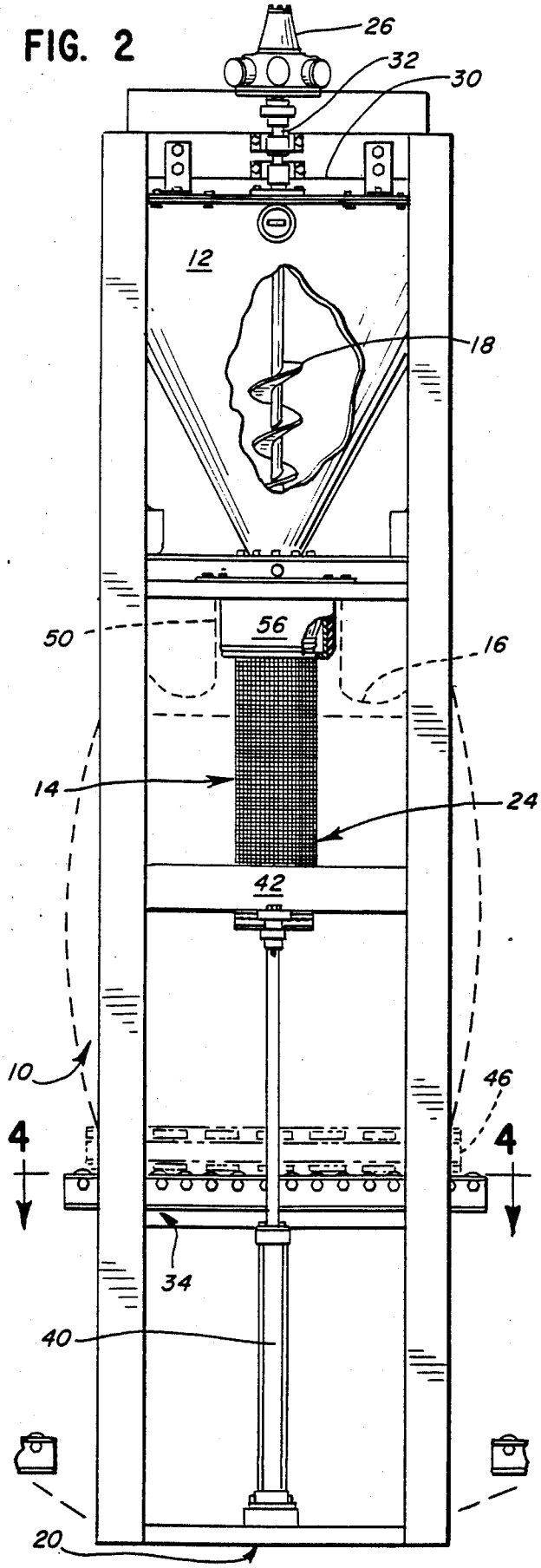
FIG. 3
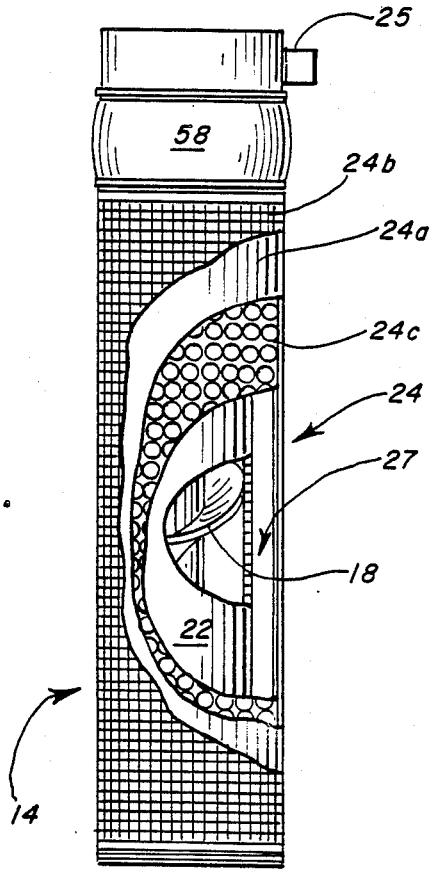
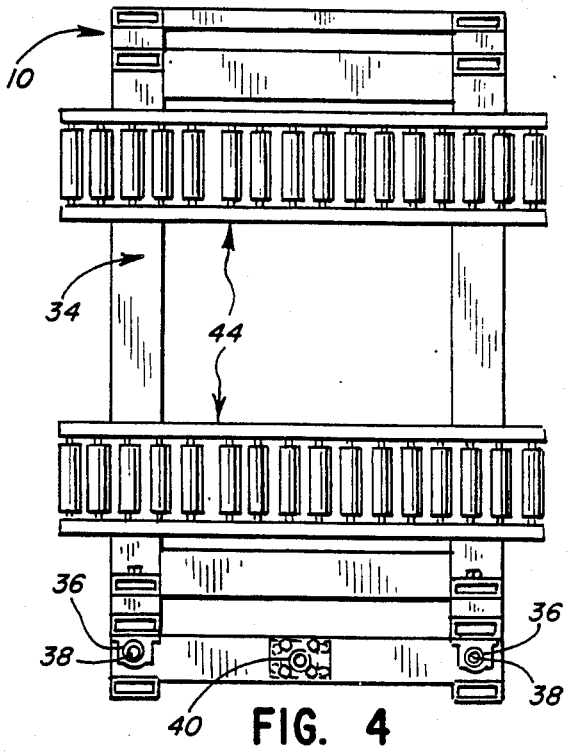
FIG. 4

METHOD AND APPARATUS FOR FILLING BULK BAGS

BACKGROUND OF THE INVENTION

The invention relates to a method and apparatus for filling bulk bags with particulate or powdered material. When a bulk bag is filled with particulate material, air may be mixed with the material and entrapped in the bag, distributed throughout the material. This reduces the amount of material which can be loaded into the bag. Also, bags containing a substantial amount of air in the particulate material are more difficult to handle than bags containing more densely packed particulate material, and may be unstable when stacked.

Accordingly, it is a general object of the invention to provide improved means for densely packing particulate material into a bulk bag.

SUMMARY OF THE INVENTION

The invention provides a method and apparatus employing a filling tube assembly which extends downwardly from a hopper into a bag and which includes an inner tubular wall defining a passage for downflow of material and an air-permeable outer tubular wall cooperating with the inner tubular wall to define an annular exhaust passage for removal of air from the bag. An auger is disposed within the inner tubular wall to positively displace material downward therethrough. As the auger forces material into the bag, the filling tube assembly becomes partially submerged in the material. Air is drawn out of the material radially inward through the outer wall and upward through the exhaust passage. The material is prevented from passing inwardly through the outer wall by filter media.

In the preferred method, the bag is supported by weighing means, and powdered material is loaded into the bag until the weighing means registers a predetermined target weight, indicating the weight on the bag to be equal to the weight of material desired to be loaded. However, because the auger applies downward force to the material in the bag, the weighing means will register the target weight before the desired amount of material is loaded into the bag. Accordingly, after the target weight is registered, the filling tube assembly is partially withdrawn and the bag trimmed to the desired weight while the filling tube assembly is suspended above the powdered material in the bag to avoid exerting downward force thereon. Withdrawal of the filling tube assembly from the bag is preferably accomplished by lowering the bag while maintaining the filling tube assembly in a stationary position.

After trimming the bag, the bag is subsequently lowered further to effect complete withdrawal of the filling tube assembly from the bag. The bag may then be sealed, removed, and replaced with an empty bag.

BRIEF DESCRIPTION OF THE DRAWINGS

FIG. 2 is a side elevational view of the apparatus of FIG. 1, showing the bag and platform supporting the bag in an elevated position.

FIG. 3 is an enlarged view of the filling tube assembly of the apparatus of FIGS. 1 and 2, partially broken away.

FIG. 4 is a sectional view taken along Line 4—4 in FIG. 2.

DETAILED DESCRIPTION OF PREFERRED EMBODIMENT

Figure 1:
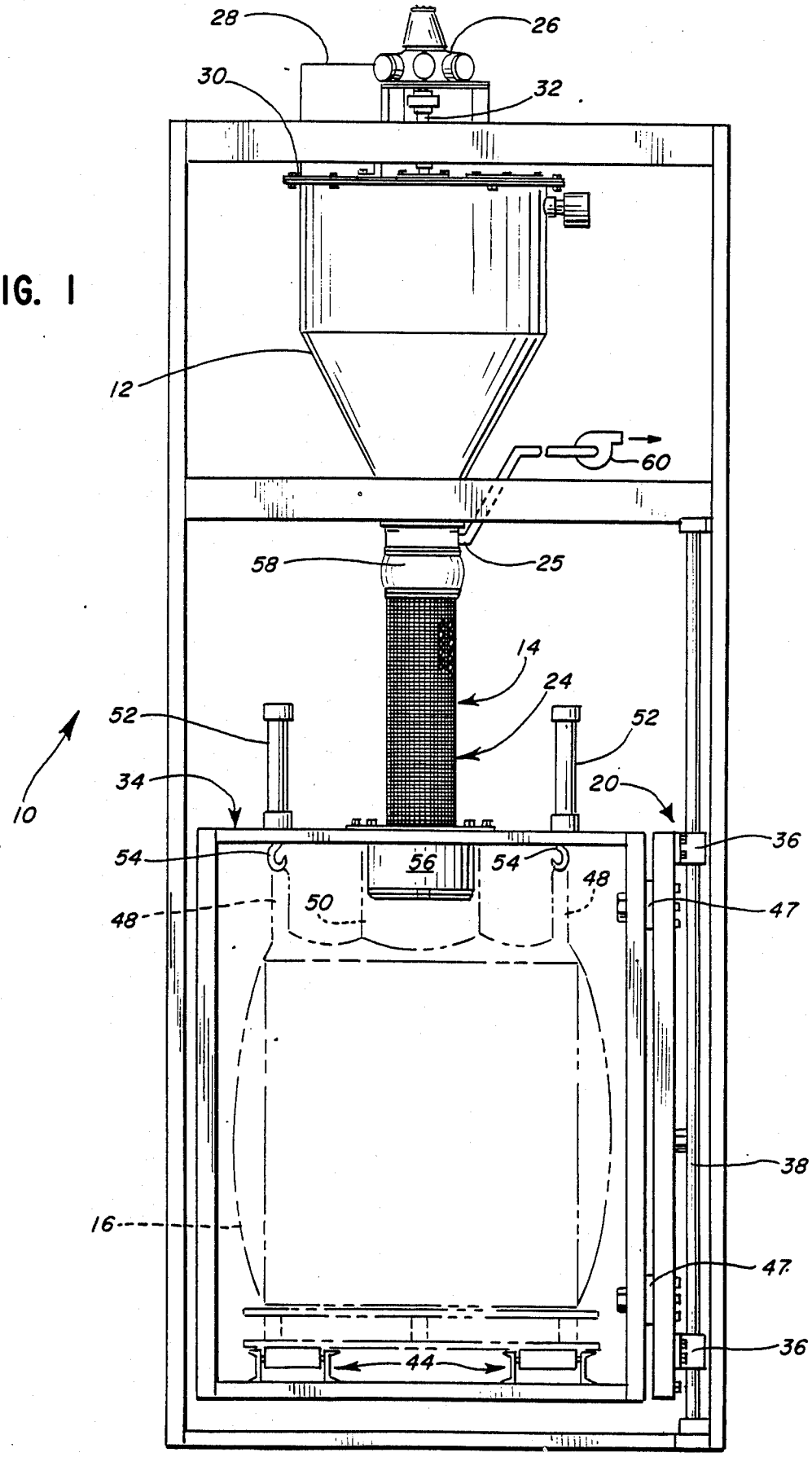
FIG. 1 is a front elevational view of the apparatus of the invention.

The apparatus of the invention generally comprises a frame 10, a hopper 12 supported at the upper end of the frame, and a filling tube assembly 14 extending downward beneath the hopper 12 for transmitting powdered material from the hopper 12 to a bulk bag 16. To effect downward flow of material from the hopper through the tube assembly into the bulk bag 16, a rotating auger 18 extends vertically downward through the hopper 12 and the tube assembly 14. To support the bulk bag 16 beneath the hopper 12, a lifting assembly 20 is disposed beneath the hopper 12.

The filling tube assembly 14 includes an inner tubular wall 22 defining an inner passage for downward flow of powdered material and an outer tubular wall 24 spaced from the inner tubular wall 22 by an annular space 27. The outer wall 24 is permeable to air but substantially impermeable to powdered material so that air can be withdrawn from the bag 16 as the bag is filled by maintaining the annular space 27 between the tubular walls at subatmospheric pressure. To this end, an exhaust line 25 extends through the outer tubular wall 24 near its upper end. The generally cylindrical outer tubular wall preferably includes a layer of filter cloth **24*a* disposed between an outer screen 24*b* and an inner screen 24*c*. The inner screen 24*c* is relatively stiff, and strong enough to prevent the filter cloth 24*a* from collapsing. The outer screen 24*b* functions primarily to retain the filter cloth 24*a*** in place.

The hopper 12 is sealed by a cover 30 to prevent contamination or escape of powdered material. Powdered material enters the hopper 12 through a product inlet pipe 28 mounted on top of the cover 30. The illustrated screw-type auger 18 extends upwardly from the bottom of the filling tube assembly 14 to an elevation about halfway between the top and bottom of the hopper 12. The auger 18 is rotated by a hydraulic motor 26 located at the top of the frame 10 and connected to the auger by a vertical drive shaft 32 which extends through the cover 30.

The lifting assembly 20 which supports the bulk bag 16 includes a movable frame 34 supported on linear bearings 36 on vertically extending rods 38 which are supported by the main frame 10. A hydraulic cylinder 40 is connected to a horizontal member 42 of the movable frame 34 to effect upward and downward movement thereof. The movable frame 34 has a dual roller conveyor 44 at its bottom for supporting the bulk bag. The bag 16 will typically be positioned on a pallet 46 to facilitate handling by forklift. As illustrated in FIG. 2, the conveyor 44 at the bottom of the movable frame 34 may be part of a longer conveyor line extending on either side of the frame 34 so that bags may be lined up and rolled on and off the assembly 20.

Weighing means are provided to enable the weight of material in the bag 16 to be measured. The weighing means preferably comprise four load cells 47 which support the weight of the bag 16, pallet 46 and a major portion of the movable frame 34. The load cells transmit electronic signals to a receiver which registers the total weight carried by the load cells. The bulk bag 16 has straps 48 at its upper corners which may be lifted upwardly to assist in providing the bag with a desired shape, and a spout 50 extending upwardly at the center of its upper end to facilitate filling. The lifting assembly 20 includes air cylinders 52 mounted at the top of the movable frame 34 having hooks 54 depending therefrom for lifting the straps 48 as desired. An inflatable seal 56 for engaging the interior of the spout 50 on the bag is also mounted at the top of the frame 34. The inflatable seal 56 has a variable exterior diameter so that when deflated it can be inserted easily into the bag spout 50, and when inflated its exterior seals against the interior of the bag spout to 50 prevent leakage or contamination of the bag contents and to support the bag spout in a desired position.

To enable the interior of the bag 16 to be isolated from the surrounding environment during filling, a second inflatable seal 58 is provided at the upper end of the filling tube assembly 14 for cooperation with the inflatable seal 56 on the frame 34. When the frame 34 is in an upper position and the second seal 58 is inflated and disposed within the first seal 56, its exterior seals against the interior of the first seal 56.

To fill the bulk bag 16 using the apparatus of the invention, the first step is to place the bag 16, supported on the pallet 46, on the conveyor 44 by rolling the pallet 46 from an adjoining length of conveyor track onto the conveyor 44. The straps 48 on the bag are then hung on the hooks 54 above the upper end of the bag, and the spout 50 is raised and placed around the first inflatable seal 56. The weighing means is then zeroed. That is, the weight of the pallet 46 and bulk bag 16 are tared out. The seal 56 is inflated to secure the spout 50 in place and the hooks 54 are raised to provide the desired shape for the bag 16.

At this point the lower end of the filling tube assembly 14 is disposed within the spout 50 and seal 56, slightly above the top wall of the bag 16. The assembly 20 is then raised so that the second seal 58 is located within the first seal 56, which effects insertion of the filling tube assembly 14 into the bag interior. The second seal 58 is then inflated as described above to isolate the interior of the bag 16 from the surrounding environment.

Once the preceding steps have been completed, the auger 18 begins rotation to begin filling the bag 16, and a vacuum pump 60 begins withdrawing air from the bag 16. As material enters the bag 16, it carries with it air, and also displaces air previously in the bag. The vacuum pump 60 draws air radially inwardly through the outer wall 24 of the filling tube assembly 14, upward through the space 27 between the inner and outer walls 22 and 24, and out through the exhaust line 25.

As the auger 18 begins rotation, the powdered material is extruded downwardly from the filling tube assembly 14 into the bottom of the bag 16. Initially, the material falls from the bottom of the filling tube assembly 14 to the bottom of the bag 16 under the force of gravity. Once material has been added to the bag to a depth sufficient to reach the bottom of the filling tube assembly, the action of the auger 18 effects churning or agitation of the material as the material extruded from the filling tube assembly 14 displaces previously extruded material.

It has been found that the combination of the action of the auger 18 and the intake of air over the substantially cylindrical area of the outer tubular wall 24 enables material to be packed into the bag at much higher density than that provided by known commercial bag filling apparatus. It is believed that the successful cooperation between the auger 18 and the air withdrawal system derives partially from the churning of the material in the bag, which helps to release air therefrom so that it may be drawn through the outer tubular wall 24. Also, as the bag 16 fills, the pressure on the material at the bottom of the bag increases due to the weight of the material above it and the action of the auger 18, and this tends to increase the volume of airflow through the outer tubular wall 24, particularly near the lower end thereof.

If the bottom of the filling tube assembly 14 is too close to the bottom of the bag 16, flow of material from the filling tube assembly 14 may be impeded, and the time required to fill the bag 16 will increase. If the bottom of the filling tube assembly 14 is too far from the bottom of the bag 16, the benefits of immersion of the filling tube assembly 14 in the material during filling are realized only for a relatively short portion of the filling cycle, which may reduce the amount of air removed, thus decreasing the density of the material in the bag. It has been found that insertion of the filling tube assembly 14 to a depth of about two-thirds of the bag height provides acceptable performance for filling most powdered materials into standard bags. However, some of the benefits of the invention may be realized by extension of the filling tube assembly 14 into the bag 16 to a depth of, for example, only one-third of the bag height, or to a depth greater than two-thirds of the bag height.

The height of a typical bag 16 not including the filling spout 50, is about 42 inches. When the movable frame 34 is in its lowest position, the bottom of the filling tube assembly 14 extends about six inches into the spout 50, but does not extend into the bag 16 itself. To enable the desired penetration to be achieved, the movable frame 34 preferably has a vertical range of motion of about 30 inches, and the filling tube assembly 14 has a height of about 14 inches.

To fill the bag 16 to a desired weight, the auger 18 continues operating until the weighing means registers a preset target weight, at which time the filling tube assembly 14 is partially immersed in powdered material. The registration of the target weight at this point will be partially due to the downward pressure exerted on the material in the bag 16 by the auger 18, and the quantity of powdered material in the bag 16 will be less than the desired amount.

Accordingly, once the target weight is registered, the auger 18 is temporarily stopped and the second seal 58 is deflated to release the first seal 56 so that it may travel downwardly along the exterior of the filling tube assembly 14. An inwardly-extending lip is disposed at the bottom of the first seal 56 to slide along the exterior of the outer tubular wall to scrape accumulated powdered material therefrom. After the frame 34 is partially lowered, the auger 18 is briefly reactivated to trim the bag 16 to the target weight. At this point, the weighing means will give an accurate indication of the actual weight of the material in the bag. Once the bag 16 has been thus trimmed, the frame 34 is fully lowered to align the conveyor 44 on the movable frame 34 with the adjoining sections of conveyor 44. The first seal 56 is then deflated, the straps 48 are released from the hooks 54, and the bag 16 is rolled to an adjacent section of conveyor.

The above method may be repeated to fill successive bags. The method and apparatus described above have been found suitable for use with powdered material including fines having a major dimension of 3 to 5 microns, and typically enable filling of bags at a rate of about 12 per hour. The rate of filling depends to some extent on the material being filled. Relatively large quantities of air may be present in material transported by pneumatic conveyor prior to loading, and accordingly, longer filling times may be expected for such material.

The provision of the lip at the bottom of the first seal 56 to clean the filter has been found effective to avoid any need to employ other methods to clean the exterior of the outer tubular wall 24 has been found effective to avoid any need to employ other methods to clean the wall 24 between or during uses. It may also be noted that the churning action of the material due to the force of the auger 18 helps to prevent undesirable accumulations of very dense powder on the exterior of the outer tubular wall 24. However, if desired, means may be provided for introducing high pressure pulses into the annular exhaust passage 27 to reverse flow through the filter temporarily to break up any deposits of powdered material which accumulate on the exterior of the filling tube assembly 14 during operation.

From the foregoing it will be appreciated that the invention provides a novel method and apparatus which enable bulk bags to be filled with powdered material more quickly and efficiently, and with greater product density, than the prior art. The invention is not limited to the preferred embodiments described herein, or to any particular embodiments.

What is claimed is:

1. Apparatus for filling with powdered material bulk bags of the type having filling openings at their upper ends, said apparatus comprising:

a frame;

a hopper supported by said frame;

a filling tube assembly extending downwardly beneath said hopper and comprising an inner tubular wall defining a first passage for downward flow of material from said hopper and an outer tubular wall cooperating with said inner tubular wall to define an annular air passage between said walls;

a rotating auger disposed partially within said hopper and partially within said inner tubular wall for forcing material downwardly from said hopper through said inner tubular wall;

lifting means mounted on said frame for supporting a bulk bag beneath said hopper and moving said bulk bag vertically;

sealing means comprising a first sealing element disposed on said lifting means for engaging an interior portion of said bag adjacent the filling opening thereof, said first sealing element being movable with said bag, and a second sealing element disposed at the upper end of said filling tube assembly for engaging an interior portion of said first sealing element and sealing thereagainst when said bag is in an upper position; and vacuum means for removing air from said bag by drawing said air radially inwardly through said outer tubular wall and upward through said annular air passage.

2. Means for bulk packaging of particulate material, comprising:

a frame;

a hopper supported by said frame;

a filling tube assembly extending downwardly beneath said hopper, said filling tube assembly comprising an inner tubular wall defining a first passage for downward flow of material from said hopper, and an air permeable outer tubular wall cooperating with said inner tubular wall to define an annular air passage between said tubular walls;

an auger extending downward from said hopper into said first passage to positively displace material downward from the hopper through the first passage;

a bag disposed beneath the hopper for receiving materials passing through said first passage, said bag having a predetermined height and having an upwardly extending filling spout defining a filling opening; and lifting means for moving the bag between an upper position wherein the filling tube assembly extends into the bag to a depth of at least one-third of the bag height and a lower position wherein the filling tube assembly is substantially withdrawn from the bag; and sealing means comprising a first sealing element disposed on said lifting means for engaging an interior portion of said bag adjacent the filling opening thereof, said first sealing element being movable with said bag, and a second sealing element disposed at the upper end of said filling tube assembly for engaging an interior portion of said first sealing element and sealing thereagainst when said bag is in said upper position;

whereby the filling tube assembly may be partially submerged in material in the bag during filling to facilitate withdrawal of air through the outer wall.

3. Means in accordance with claim 2 wherein the filling tube assembly extends into the bag to a depth of substantially two-thirds of the bag height when the bag is in said upper position.

4. Means in accordance with claim 2 wherein the auger extends downward from the interior of the hopper to the lower end of the filling tube assembly.

5. Means in accordance with claim 2 wherein said first sealing element has an inwardly extending lip thereon for engaging the exterior of said filling tube assembly, so that downward movement of said first sealing element relative to said filling tube assembly effects a wiping action on the exterior of said filling tube assembly.

* * * * *